US008713815B2

(12) United States Patent
Abramov et al.

(10) Patent No.: US 8,713,815 B2
(45) Date of Patent: May 6, 2014

(54) METHOD AND DEVICE FOR DRYING BULK CAPILLARY-POROUS MATERIALS

(75) Inventors: Yakov Kuzmich Abramov, Moscow (RU); Vladimir Mihailovich Veselov, Moscow (RU); Viktor Mihailovich Zalevsky, Moscow (RU); Vitaly Grigorevich Tamurka, Moscow (RU); Vladimir Dmitrievich Evdokimov, Moscow (RU); Veniamin Sergeevich Volodin, Moskovskaya obl. (RU); Svetlana Nikolaevna Khapaeva, Moscow (RU); Anatoly Fedorovich Khanin, Moscow (RU)

(73) Assignee: Twin Trading Company (RU)

( * ) Notice: Subject to any disclaimer, the term of this patent is extended or adjusted under 35 U.S.C. 154(b) by 24 days.

(21) Appl. No.: 13/390,694

(22) PCT Filed: Aug. 13, 2010

(86) PCT No.: PCT/RU2010/000448

§ 371 (c)(1),
(2), (4) Date: Feb. 16, 2012

(87) PCT Pub. No.: WO2011/021966

PCT Pub. Date: Feb. 24, 2011

(65) Prior Publication Data

US 2012/0144690 A1 Jun. 14, 2012

(30) Foreign Application Priority Data

Aug. 21, 2009 (RU) ..... 2009131585

(51) Int. Cl.
*F26B 5/04* (2006.01)

(52) U.S. Cl.
USPC ..... 34/412; 34/361; 34/362; 34/381; 34/391

(58) Field of Classification Search
USPC ..... 34/361, 362, 380, 381, 391, 410, 412
See application file for complete search history.

(56) References Cited

U.S. PATENT DOCUMENTS

2012/0066927 A1 * 3/2012 Abramov et al. ..... 34/410

FOREIGN PATENT DOCUMENTS

| | | |
|---|---|---|
| EP | 2034263 | 3/2009 |
| RU | 23028584 | 11/1995 |
| RU | 2163993 | 8/1998 |
| RU | 2124294 | 1/1999 |
| RU | 2232955 | 7/2004 |
| RU | 2351860 | 4/2009 |

* cited by examiner

*Primary Examiner* — Jiping Lu
(74) *Attorney, Agent, or Firm* — Yefim Kreydin

(57) ABSTRACT

The present invention relates to the vacuum drying of capillary porous bulk materials.

The method involves preheating of the material, its loading into the vacuum drying chamber having heating elements followed by cycle-by-cycling heating of the material and vacuum creation in the rapid vacuum impulse action mode with stage-by-stage single or multiple reduction of pressure in the range from 0.1 MPa to 0.0001 MPa followed by the exposure to vacuum unless the material temperature is stabilized. Said cycles are repeated unless the required material moisture is achieved. Cooling of the material is performed in the same drying chamber by alternating cooling in spouted bed and vacuum impulse action.

The device comprises two vacuum chambers cone-shaped at their bases with heaters mounted inside them, material loading/unloading system, one or several receivers with pumps connected in parallel to them and connected via vacuum pipeline system with quick-acting valves to the drying chamber inlet.

17 Claims, 1 Drawing Sheet

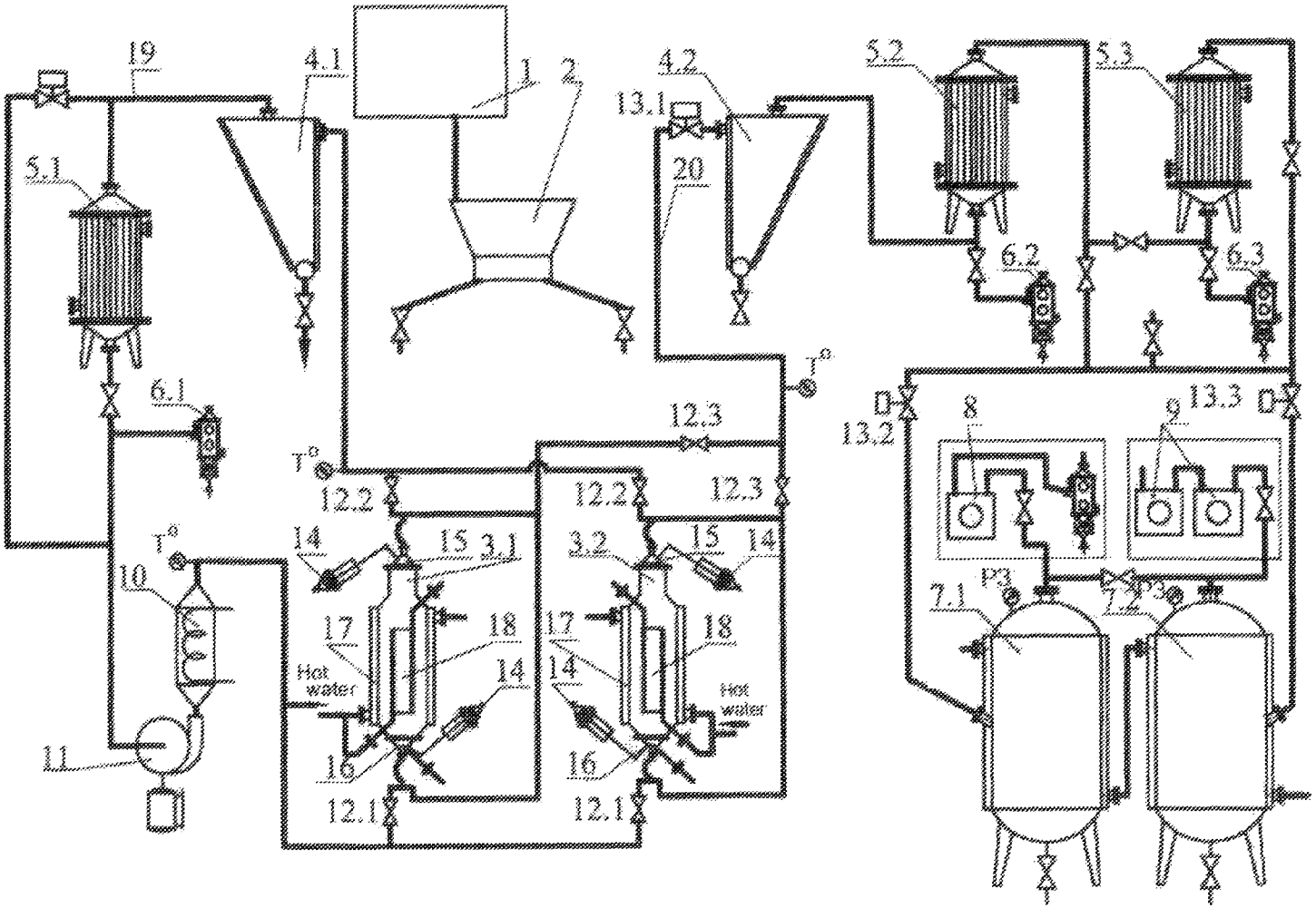
Hot water
Hot water

METHOD AND DEVICE FOR DRYING BULK CAPILLARY-POROUS MATERIALS

This application is the United States national phase application of International Application PCT/RU2010/000309 filed Jun. 11, 2010, which claims the benefit of Russian Patent application No RU 2009131585 FILED Aug. 21, 2009, the entire disclosure of which is incorporated herein by reference.

BACKGROUND OF THE INVENTION

The present invention relates to the vacuum drying of capillary porous bulk materials, primarily grain, and can be used in agricultural, food-processing, woodworking, chemical and other industries.

There are known drying methods for capillary porous bulk materials, including grain, that use preheated drying air interacting with the material subject to drying under fluidization conditions in order to remove hygroscopic moisture (application RF N 93028584, MPK Cl.F26B17/10).

The disadvantage of this method is low process economy due to the high consumption of drying agent, difficulties in organizing control over the material heating temperature and exposure time for separate particles of the material in the reaction zone that influence both material drying time and quality of the material subject to drying.

There are known vacuum drying methods for capillary porous bulk materials, primarily grain, involving the use of a vacuum chamber for the material subject to drying and reduction of pressure in this chamber to 10-30 mm of Hg column using a vacuum pump. The heat is supplied to the grain subject to drying from the ambient air and solar radiation (Patent RF N 2163993, MPK Cl. F26B 5/00, 5/04, 7/00; A01C 1/00; B02B 1/00).

The unit used for this grain vacuum drying method comprises a vacuum chamber made of two tubes coaxially located to each other and mounted vertically in open air connected to the vacuum pump and refrigerator with freezer and condensing units.

The main disadvantage of this method and the unit used for it is that the method is low efficient since heating of the material depends on the environmental conditions and the whole vacuum drying process also become dependent on such conditions, therefore limiting the time of using this method and the unit to the seasons.

The method and device which are the closest by their technical essence and chosen as prototypes are the evaporation vacuum drying method for grain and device used for it (patent RF N 2124294, MPK Cl. A23B 9/00,9/08). The grain is loaded into a vacuum drying chamber that has heating elements and vacuum is created in it. The material subject to drying is additionally heated with the help of the thermal agent that uses condensation energy of the moisture evaporated in the vacuum section of the drying chamber and coming from the other section of the chamber. The grain is being cooled by removing heat from the heat medium coming out from the drying chamber, which, in its turn, is used for preheating grain before it is loaded into the drying chamber.

This method works in the device used for drying grain in vacuum and comprising a vacuum drying chamber divided into steam and grain sections by a louver screen, a heater located in the grain section, inlet and outlet rotary locks, a vacuum pump, a heat-exchanger-cooler united with a heat-exchanger-heater for preheating the grain by pipelines into one closed-loop system and a pipework for heat medium circulation and condensate release. The heater has a panel of tubes with input annular nozzles and output diffusers on each tube, wherein the said panel of tubes is located in a case connected with the steam section of the drying chamber, inputs of the tubes are connected with the heater's outlet and outputs of the tubes—with its inlets via a pump. Water containing surface active agents is used as heat medium.

The disadvantage of this method is that the drying process is performed in a balanced condition, which at low pressure both complicates supply of thermal energy to the material and increases drying time. Besides, the device realizing the said method has a complicated design and requires considerable material costs for non-standard equipment, including a control system.

SUMMARY OF THE INVENTION

An object of the present invention is to reduce time required for drying capillary porous bulk materials, primarily grain, as well as to ensure its high quality due to more intensive heating of the latter at the stage of convection drying and intense moisture removal in unbalanced conditions during impulse vacuum processing, while making it possible to implement the said method in the claimed unit with simple design and, thus, reducing investment costs and embodied energy.

The above task is accomplished by that in the drying method for capillary porous bulk materials, primarily grain, using moisture removal, which involves preheating the material, its loading into the vacuum drying chamber having heating elements, heating with heat medium, vacuum creation in the drying chamber, cooling and release of the material, the said heating of the material with heat medium and vacuum creation are performed cycle-by-cycle, including spouted bed heating with the heat medium which has temperature of up to 300° C. to the material temperature lower than its destruction temperature, and also vacuum creation in the rapid vacuum impulse action mode with stage-by-stage single or multiple reduction of pressure in the range from 0.1 MPa to 0.0001 MPa followed by the exposure to vacuum until the material temperature is stabilized, wherein the said cycles are repeated unless the required material moisture is achieved and the further cooling is performed in the same drying chamber by alternating spouted bed cooling and vacuum impulse action.

The material is loaded into the drying chamber via solid-layer vacuum transport using vacuum impulse actions in order to pre-dry it at the same time.

Depending on the properties of the materials, gaseous agent with up to 100% humidity can be used as a heat medium.

Where necessary, the capillary porous bulk materials are being heated using the thermal agent which is chemically inert to the material.

The number of stages of vacuum impulse actions is calculated according to the below formula:

$$n=lg[(Pi-Pr)/(Pf-Pr)]/lg(k+1), \text{ where}$$

Pi—initial pressure in vacuum chamber, Pa (process initial pressure)

Pr—pressure produced in receiver, Pa

Pf—final pressure in vacuum chamber, Pa (process end pressure)

K—factor equal to ratio of vacuum drying chamber and receiver volumes

This method is implemented in the device used for drying capillary porous bulk materials, comprising a vacuum drying chamber, a heater mounted in the drying chamber, material loading/unloading system, a vacuum pump, a heat exchanger-cooler, pipeline system for heat medium circulation and condensate release, wherein the said device is provided with one or several receivers with vacuum pumps connected in parallel to them, and the said vacuum pumps are connected via vacuum pipelines with quick-acting valves to the drying chamber inlet and additionally provided with the second drying chamber mounted in parallel to the first, and wherein each vacuum drying chamber is cone-shaped at its base, and the said second drying chamber is connected to the heat medium circulation system for both spouted bed heating and cooling of the material and has a heating jacket, and the said heat medium vacuum treatment and circulation lines have heated cyclone filters and heat exchangers-condensers (coolers) with condensate tanks.

Vacuum transport solid-layer material feeding system which allows to use vacuum impulse actions is mounted at the inlet to drying chambers.

In case of large volumes of the material subject to drying the said device can additionally comprise one or several pairs of drying chambers, cone-shaped at their bases, for heating or cooling the material in spouted bed and equipped with heating jackets and mounted in parallel to the first drying chamber.

The receivers used in the said device and connected in parallel to the pumps (vacuum drying line) allow to reduce drying time due to step-by-step vacuum feeding, first from the first receiver and then from the second receiver with deeper vacuum.

Spouted bed heating (convection drying) of the grain offers the advantage of uniform Full-volume heating excluding stagnation zones that makes the heating process time- and volume-controllable. In the spouted bed a factor of heat transfer from the heat medium to the material increases by 2-3 times due to the cyclic movement of capillary porous bulk particles that also makes the drying time shorter in general, while intensifying moisture removal in unbalanced conditions.

The claimed method for drying different capillary porous bulk materials, including grain, reduces drying time and increases quality of the dried material while preheating it and, in particular, when feeding it into a dryer via solid-layer vacuum transport and intensively heating it in spouted bed to the temperature which does not cause destruction (denaturation) of the material (37-48° C.), and, furthermore, by ensuring intensive moisture removal using pulsating vacuum modes in unbalanced thermodynamic conditions and cooling the material in heat exchange conditions in spouted bed with impulse vacuum treatment of the material using internal heat in order both to evaporate moisture and cool the product.

DETAILED DESCRIPTION OF THE EXEMPLARY EMBODIMENT

The present invention becomes clear from the drawing (see FIG. 1) which shows a diagram of the unit used for drying capillary porous bulk materials, primarily grain. The said device comprises one or several pairs of vacuum chambers equipped with heating jackets 17 and heaters 18 inside the chambers, from which one pair is shown in FIG. 1 (two heated vacuum chambers 3.1 and 3.2), having open/close operation drives 14 of upper 15 and lower 16 cover, solid-layer vacuum transport 1, receiving bunker 2 used for distribution of the material being dried to vacuum chambers, gas thermal agent heater 10, fan 11, two heated cyclones 4.1 and 4.2 for cleaning thermal agent, heat exchangers-condensers 5.1, 5.2, 5.3, condensate tanks 6.1, 6.2, 6.3 for drying heat medium and collecting different valuable components removed from the material during the drying process, vacuum creation system consisting of two types of vacuum pumps 8 and 9 producing different pressures, and one or several receivers 7.1 and 7.2 and pipeline system 19 for heat medium circulation 20 for vacuum system with quick-acting valves 12.3, 13.1, 13.2, 13.3.

The claimed drying method for capillary porous bulk materials and operation of the unit start with sequential feeding of the material to vacuum drying chambers. Let us consider this by the example of one drying chamber. Preheated material (not shown in FIG. 1) is loaded into distribution bunker 2. The material from receiving bunker 2 is dose-supplied via open upper cover 15 into vacuum chamber 3.1 and after that cover 15 is tightly closed. Gas heat medium heated to 300° C. is supplied to lower section of the chamber via valves 12.1 and discharged from upper section of the chamber via valve 12.2. At the same time hot fluid heat medium is supplied to drying chamber jacket 17 and heater 18 inside the chamber. The gas heat medium passing through the material forms a spouted bed due to which an intensive zone carrying over the material upwards is formed in the centre of the vacuum chamber, and then the material goes downwards via a perimeter zone. Intensive heat exchange takes place in both central and perimeter zones involving heating of the material to the required temperature, which does not cause destruction of the material, while due to simultaneous mixing and absence of stagnation zones the material contacts with the gas heat medium within a strictly specified time.

Dissolved vapors from the gas heat medium passing through condenser 5.1 are condensed and collected in condensate tank 6.1. In order to prevent contamination of the gas heat medium system it is cleaned from foreign matters in cyclone 4.1 which is heated in order to avoid premature condensation of vapors in the cyclone. After condenser 5.1 the heat medium enters heater 10 that allows to make a closed loop of gas heat medium movement.

After the required material heating temperature is reached, the heat medium is no longer supplied to vacuum chamber 3.1, valves 12.1, 12.2 are closed and quick-acting valves 12.3, 13.1 are opened. The latter connect vacuum chamber 3.1 via cyclone 4.2, heat exchangers-condensers 5.2 and 5.3, vacuum pipeline system with receivers 7.1 and 7.2, in which the required rarefaction (vacuum) with pressure Pr is pre-created. The material in the vacuum chamber is subject to fast (impulse) vacuum action leading to the intensive moisture removal in unbalanced conditions and, hence, to the decrease of the material temperature. Vapor-gas mixture passing through condensers 5.2, 5.3 is freed from vapors and their condensate is collected into corresponding condensate tanks 6.2 и 6.3. The use of two or more heat exchangers-condensers on the vacuum treatment line allows to separate vapors by their boiling temperature into different fractions.

The claimed connection diagram for receivers 7.1, 7.2 and vacuum pumps 8 and 9 allows to apply step-by-step vacuum treatment and ensure the most favorable conditions for drying materials as well as the reduction of drying time.

After the vacuum impulse is passed through and the vacuum chamber 3.1 is exposed to vacuum within 5-10 minutes, valves 12.3, 13.1 are closed—the 1st drying cycle is over. Depending on the properties of the material subject to drying and the required level of its drying there should be several drying cycles.

After the drying process is finished, the dried material is being cooled in drying chamber 3.1 using gas agent in spouted bed while heater 10 is off and several vacuum impulse actions are being performed. In these conditions the material is immediately cooled and ready for further processing.

The application of the second drying chamber as well as of several pairs of drying chambers allows to make an efficient use of the processing time.

The design of the claimed drying unit is fundamentally new and fully complies with the positions for the developed drying method.

The invention claimed is:

1. A drying method for capillary porous bulk materials, primarily grain, including preheating of the materials, loading the materials into the vacuum drying chamber with heating elements, heating of the material with heat medium, creating a vacuum in the drying chamber, cooling and release of material, wherein said heating of the material with heating medium and creation of vacuum are performed cycle-by-cycle, including heating in a spouted bed with the temperature up to 300° C. which is lower than the temperature of material decomposition, as well as the creation of vacuum in a quick vacuum-impulse mode with a single pressure reduction, followed by exposure under vacuum until the material temperature is stabilized wherein the said cycles are repeated unless the required material moisture is achieved.

2. The drying method for capillary porous bulk materials according to claim 1, wherein the material is being loaded into the drying chamber with simultaneous pre-drying of the former material via solid-layer vacuum transport using vacuum impulse actions.

3. The drying method for capillary porous bulk materials according to claim 1, wherein a gaseous agent with humidity of up to 100% is used as the said heat medium.

4. The drying method for capillary porous bulk materials according to claim 1, wherein the material is being heated using the heat medium which is chemically inert the material.

5. The drying method for capillary porous bulk materials according to claim 1, wherein cooling of the materials is performed in the same drying chamber with cooled medium in spouted bed.

6. The drying method for capillary porous bulk materials according to claim 1, wherein cooling of the materials is performed in the same drying chamber under vacuum impulse action.

7. The drying method for capillary porous bulk materials according to claim 1, wherein the said vacuum creation in a quick vacuum-impulse mode is carried out by the single pressure reduction within the range of 0.1-0.0001 Mpa.

8. The drying method for capillary porous bulk materials according to claim 1, wherein the cooling of the said material is carried out in the same vacuum dry chamber by alternating the cooling in the spouted bed with cooled medium, supplied into the base of the vacuum drying chamber, and by vacuum-impulse actions.

9. A drying method for capillary porous bulk materials, primarily grain, including preheating of the materials, loading the materials into the vacuum drying chamber with heating elements, heating the material with heating medium, creating a vacuum in the drying chamber, cooling and release of material, wherein said heating of the material with heating medium and creation of vacuum are performed cycle-by-cycle, including heating in a spouted bed with the temperature up to 300° C., which is lower than the temperature of material decomposition, as well as the creation of vacuum in a quick vacuum-impulse mode with a stage-by-stage multiple pressure reduction, followed by exposure under vacuum until the material temperature is stabilized wherein the said cycles are repeated unless the required material moisture is achieved.

10. The drying method for capillary porous bulk materials according to claim 9, wherein a number of stages of vacuum impulse actions is defined according to a formula:

$$n=lg[(Pi-Pr)/(Pf-Pr)]/lg(k+1),$$

where

Pi—initial pressure in vacuum chamber, Pa (process initial pressure)

Pr—pressure produced in receiver, Pa

Pf—final pressure in vacuum chamber, Pa (process end pressure)

K—factor equal to ratio of vacuum drying chamber and receiver volumes.

11. The drying method for capillary porous bulk materials according to claim 9, wherein the cooling of materials is performed in the same drying chamber with cooled medium in spouted bed.

12. The drying method for capillary porous bulk materials according to claim 9, wherein cooling of the materials is performed in the same drying chamber under vacuum impulse action.

13. The drying method for capillary porous bulk materials according to claim 9, wherein the material is being loaded into the drying chamber with simultaneous pre-drying of the material via solid-layer vacuum transport using vacuum impulse actions.

14. The drying method for capillary porous bulk materials according to claim 9, wherein a gaseous agent with humidity up to 100% is used as the said heat medium.

15. The drying method for capillary porous bulk materials according to claim 9, wherein the material is being heated using the heat medium which is chemically inert to the material.

16. The drying method for capillary porous bulk materials according to claim 9, wherein the said vacuum creation in a quick vacuum-impulse mode is carried out by the multi-stage pressure reduction within the range of 0.1-0.0001 Mpa.

17. The drying method for capillary porous bulk materials according to claim 9, wherein the cooling of the said material is carried out in the same vacuum dry chamber by alternating the cooling in the spouted bed with cooled medium, supplied into the base of the vacuum drying chamber, and by vacuum-impulse actions.

* * * * *